US010550674B2

(12) United States Patent
Boyd et al.

(10) Patent No.: US 10,550,674 B2
(45) Date of Patent: Feb. 4, 2020

(54) INTERNAL VALVE PLUNGER

(71) Applicant: FlowCo Production Solutions, LLC, Fort Worth, TX (US)

(72) Inventors: Mitchell A. Boyd, Haslet, TX (US); Garrett S. Boyd, Godley, TX (US); David Robert Dahlgren, Brighton, CO (US)

(73) Assignee: FlowCo Production Solutions, LLC, Fort Worth, TX (US)

( * ) Notice: Subject to any disclaimer, the term of this patent is extended or adjusted under 35 U.S.C. 154(b) by 0 days.

(21) Appl. No.: 16/294,625

(22) Filed: Mar. 6, 2019

(65) Prior Publication Data

US 2019/0277118 A1 Sep. 12, 2019

Related U.S. Application Data

(60) Provisional application No. 62/639,405, filed on Mar. 6, 2018.

(51) Int. Cl.

| | |
|---|---|
| ***E21B 43/12*** | (2006.01) |
| ***F04B 47/12*** | (2006.01) |
| ***E21B 33/068*** | (2006.01) |

(52) U.S. Cl.

CPC ..... *E21B 43/121* (2013.01); *E21B 33/068* (2013.01); *F04B 47/12* (2013.01)

(58) Field of Classification Search

CPC ..... E21B 43/121; F04B 47/12

See application file for complete search history.

(56) References Cited

U.S. PATENT DOCUMENTS

| | | | |
|---|---|---|---|
| 1,415,788 | A | 5/1922 | Burlin |
| 1,910,616 | A | 5/1933 | Leahy |
| 1,932,992 | A | 10/1933 | Sherman et al. |
| 2,018,204 | A | 10/1935 | Seth et al. |
| 2,215,751 | A | 9/1940 | Coleman |

(Continued)

FOREIGN PATENT DOCUMENTS

| | | | |
|---|---|---|---|
| CA | 2428618 | A1 | 11/2004 |
| CA | 2635993 | A1 | 12/2009 |

(Continued)

OTHER PUBLICATIONS

Bal-Seal, Bal Springtm Canted Coil Springs for Mehcanical Applications, product website, 3 pages, www.balseal.com/mechanical.

(Continued)

*Primary Examiner* — Giovanna C Wright

(74) *Attorney, Agent, or Firm* — Jason P. Mueller; Adams and Reese, LLP

(57) ABSTRACT

A bypass plunger includes a plunger body that includes a head portion located at one end of the plunger body and a tail portion located at an opposite end of the plunger body. The head portion includes at least one flow port, and the tail portion includes at least one passageway. A valve component is disposed within an internal bore of the plunger body and is movable between an open position and a closed position. At least one plug is located within a respective one of the flow ports and/or a respective one of the passageways, and is configured to reduce or prevent flow through the respective flow port or the respective passageway.

18 Claims, 7 Drawing Sheets

(56) References Cited

U.S. PATENT DOCUMENTS

| | | | |
|---|---|---|---|
| 2,301,319 | A | 11/1942 | Peters |
| 2,312,476 | A | 3/1943 | Penick et al. |
| 2,437,429 | A | 3/1948 | Hossfeld |
| 2,642,002 | A | 6/1953 | Knox et al. |
| 2,661,024 | A | 12/1953 | Knox |
| 2,676,547 | A | 4/1954 | Knox |
| 2,714,855 | A | 8/1955 | Brown |
| 2,878,754 | A | 3/1959 | McMurry |
| 2,956,797 | A | 10/1960 | Polhemus |
| 2,970,547 | A | 2/1961 | McMurry |
| 3,020,852 | A | 2/1962 | Roach et al. |
| 3,055,306 | A | 9/1962 | Tausch |
| 3,090,315 | A | 5/1963 | Milton |
| 3,127,197 | A | 3/1964 | Kretzschmar |
| 3,146,725 | A | 9/1964 | Harris |
| 3,181,470 | A | 5/1965 | Clingman |
| 3,412,798 | A | 11/1968 | Gregston |
| 3,508,428 | A | 4/1970 | Matson |
| 3,806,106 | A | 4/1974 | Hamel et al. |
| 3,861,471 | A | 1/1975 | Douglas |
| 3,944,641 | A | 3/1976 | Lemelson |
| 4,030,858 | A | 6/1977 | Coles, Jr. |
| 4,211,279 | A | 7/1980 | Isaacks |
| 4,239,458 | A | 12/1980 | Yeatts |
| 4,502,843 | A | 3/1985 | Martin |
| 4,531,891 | A | 7/1985 | Coles, III |
| 4,571,162 | A | 2/1986 | Knox |
| 4,629,004 | A | 12/1986 | Griffin |
| 4,782,896 | A | 11/1988 | Witten |
| 4,932,471 | A | 6/1990 | Tucker et al. |
| 4,951,752 | A | 8/1990 | Coleman |
| 5,218,763 | A | 6/1993 | Marker et al. |
| 5,253,713 | A | 10/1993 | Gregg et al. |
| 5,280,890 | A | 1/1994 | Wydra |
| 5,417,291 | A | 5/1995 | Leising |
| 5,427,504 | A | 6/1995 | Dinning et al. |
| 5,868,384 | A | 2/1999 | Anderson |
| 6,045,335 | A | 4/2000 | Dinning |
| 6,148,923 | A | 11/2000 | Casey |
| 6,176,309 | B1 | 1/2001 | Bender |
| 6,200,103 | B1 | 3/2001 | Bender |
| 6,209,637 | B1 | 4/2001 | Wells |
| 6,234,770 | B1 | 5/2001 | Ridley et al. |
| 6,467,541 | B1 | 10/2002 | Wells |
| 6,478,087 | B2 | 11/2002 | Allen |
| 6,554,580 | B1 | 4/2003 | Mayfield et al. |
| 6,637,510 | B2 | 10/2003 | Lee |
| 6,644,399 | B2 | 11/2003 | Abbott et al. |
| 6,669,449 | B2 | 12/2003 | Giacomino |
| 6,725,916 | B2 | 4/2004 | Gray et al. |
| 6,846,509 | B2 | 1/2005 | Chen et al. |
| 6,848,509 | B2 | 2/2005 | Myerley |
| 6,907,926 | B2 | 6/2005 | Bosley |
| 7,040,401 | B1 | 5/2006 | McCannon |
| 7,055,812 | B2 | 6/2006 | Balsells |
| 7,121,335 | B2 | 10/2006 | Townsend |
| 7,290,602 | B2 | 11/2007 | Victor |
| 7,314,080 | B2 | 1/2008 | Giacomino |
| 7,322,417 | B2 | 1/2008 | Rytlewski et al. |
| 7,328,748 | B2 | 2/2008 | Giacomino |
| 7,383,878 | B1 | 6/2008 | Victor |
| 7,438,125 | B2 | 10/2008 | Victor |
| 7,475,731 | B2 | 1/2009 | Victor |
| 7,513,301 | B2 | 4/2009 | Victor |
| 7,523,783 | B2 | 4/2009 | Victor |
| 7,819,189 | B1 | 10/2010 | Cosby |
| 7,954,545 | B2 | 6/2011 | Hearn et al. |
| 8,181,706 | B2 | 5/2012 | Tanton |
| 8,286,700 | B1 | 10/2012 | Franchini |
| 8,347,955 | B1 | 1/2013 | Sewell et al. |
| 8,448,710 | B1 | 5/2013 | Stephens |
| 8,464,798 | B2 | 6/2013 | Nadkrynechny |
| 8,627,892 | B2 | 1/2014 | Nadkrynechny |
| 8,757,267 | B2 | 6/2014 | Mitchell et al. |
| 8,863,837 | B2 | 10/2014 | Bender et al. |
| 8,893,777 | B1 * | 11/2014 | Garrett ..... E21B 43/121 166/105 |
| 9,068,443 | B2 | 6/2015 | Jefferies et al. |
| 9,677,389 | B2 | 6/2017 | Boyd et al. |
| 9,683,430 | B1 | 6/2017 | Kuykendall |
| 9,689,242 | B2 | 6/2017 | Kuykendall et al. |
| 9,790,772 | B2 | 10/2017 | Jefferies et al. |
| 10,221,849 | B2 | 3/2019 | Roycroft et al. |
| 10,273,789 | B2 | 4/2019 | Boyd et al. |
| 2003/0155129 | A1 | 8/2003 | Gray et al. |
| 2003/0198513 | A1 | 10/2003 | Wang |
| 2004/0017049 | A1 | 1/2004 | Fink |
| 2004/0066039 | A1 | 4/2004 | Muhammad et al. |
| 2004/0070128 | A1 | 4/2004 | Balsells |
| 2004/0129428 | A1 | 7/2004 | Kelley |
| 2005/0056416 | A1 | 3/2005 | Gray et al. |
| 2005/0241819 | A1 | 11/2005 | Victor |
| 2006/0024928 | A1 | 2/2006 | Seebauer et al. |
| 2006/0054329 | A1 | 3/2006 | Chisholm |
| 2006/0113072 | A1 | 6/2006 | Lee |
| 2006/0124292 | A1 | 6/2006 | Victor |
| 2006/0124294 | A1 | 6/2006 | Victor |
| 2006/0185853 | A1 | 8/2006 | Bender |
| 2006/0214019 | A1 | 9/2006 | Ollendick |
| 2006/0249284 | A1 | 11/2006 | Victor |
| 2007/0110541 | A1 | 5/2007 | Rawlins et al. |
| 2007/0124919 | A1 | 6/2007 | Probst |
| 2007/0151738 | A1 * | 7/2007 | Giacomino ..... E21B 34/14 166/372 |
| 2007/0158061 | A1 | 7/2007 | Casey |
| 2008/0029271 | A1 | 2/2008 | Bolding et al. |
| 2008/0029721 | A1 | 2/2008 | Miyahara |
| 2009/0229835 | A1 | 9/2009 | Filippov |
| 2009/0308691 | A1 | 12/2009 | Commins et al. |
| 2010/0038071 | A1 | 2/2010 | Scott et al. |
| 2011/0253382 | A1 | 10/2011 | Nadkrynechny |
| 2011/0259438 | A1 | 10/2011 | Osborne |
| 2012/0036913 | A1 | 2/2012 | Johnson |
| 2012/0204977 | A1 | 8/2012 | Lembcke |
| 2012/0304577 | A1 | 12/2012 | Reid et al. |
| 2012/0305236 | A1 | 12/2012 | Gouthaman |
| 2012/0318524 | A1 | 12/2012 | Lea, Jr. |
| 2013/0020091 | A1 | 1/2013 | Maerz |
| 2013/0133876 | A1 | 5/2013 | Naedler et al. |
| 2014/0090830 | A1 | 4/2014 | Maerz et al. |
| 2014/0116714 | A1 | 5/2014 | Jefferies et al. |
| 2014/0131107 | A1 | 5/2014 | Southard |
| 2014/0131932 | A1 | 5/2014 | Balsells et al. |
| 2014/0230940 | A1 | 8/2014 | Patton |
| 2015/0136389 | A1 | 5/2015 | Bergman |
| 2015/0167428 | A1 | 6/2015 | Hofman et al. |
| 2015/0316115 | A1 | 11/2015 | Carter |
| 2016/0010436 | A1 * | 1/2016 | Boyd ..... E21B 43/121 166/105 |
| 2016/0061012 | A1 | 3/2016 | Zimmerman, Jr. |
| 2016/0061239 | A1 | 3/2016 | Heaphy et al. |
| 2016/0108710 | A1 * | 4/2016 | Hightower ..... E21B 43/121 166/372 |
| 2016/0238002 | A1 | 8/2016 | Williams et al. |
| 2016/0245417 | A1 | 8/2016 | Boyd et al. |
| 2017/0058651 | A1 | 3/2017 | Damiano et al. |
| 2017/0122084 | A1 | 5/2017 | Brewer et al. |
| 2017/0268318 | A1 | 9/2017 | Roycroft et al. |

FOREIGN PATENT DOCUMENTS

| | | |
|---|---|---|
| CA | 2791489 A1 | 12/2012 |
| EP | 2085572 | 8/2009 |
| GB | 1458906 A | 12/1976 |

OTHER PUBLICATIONS

Lufkin, Plunger lift; Bumper Springs website, 2 pages, © 2013 Lufkin Industries, LLC www.lufkin.com.

Weatherford, Plunger Lift Systems brochure, 4 pages; © 2005 Weatherford www.weatherford.com.

(56) References Cited

OTHER PUBLICATIONS

Smalley Steel Ring Company; Constant Section Rings (Snap Rings); product brochure (website); 3 pages www.smalley.com/reatining/rings/constant-section-rings.
HPAlloys Website printout or Monel K500 (2004).
Lufkin, Lufkin Well Manager Controller for Rod Lift Systems; website, https://www.bhge.com/upstream/production-optimization/artificial-lift/artificial-lift-power-controls-and-automation.

* cited by examiner

INTERNAL VALVE PLUNGER

CROSS REFERENCE TO RELATED APPLICATIONS

The present application claims the benefit of U.S. Provisional Application No. 62/639,405, filed Mar. 6, 2018, the entire of contents of which is incorporated herein by reference.

BRIEF DESCRIPTION OF THE DRAWINGS

The accompanying drawings are part of the present disclosure and are incorporated into the specification. The drawings illustrate examples of embodiments of the disclosure and, in conjunction with the description and claims, serve to explain various principles, features, or aspects of the disclosure. Certain embodiments of the disclosure are described more fully below with reference to the accompanying drawings. However, various aspects of the disclosure may be implemented in many different forms and should not be construed as being limited to the implementations set forth herein.

DETAILED DESCRIPTION

Figure 1:
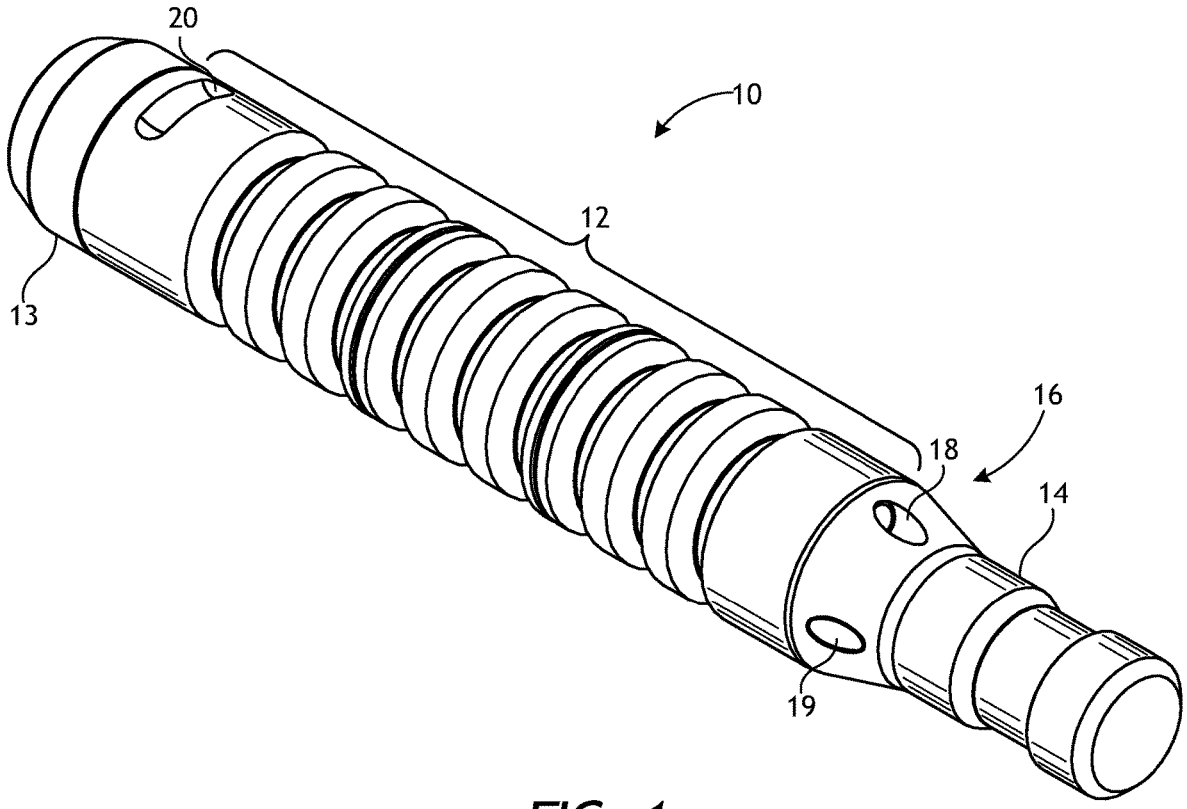
FIG. 1 illustrates a bypass plunger in accordance with the disclosure.

This disclosure generally relates to plunger assemblies and gas lift devices that travel through oil, gas, and/or other fluids within well tubing to rejuvenate low-producing or non-productive wells, and to improvements in the design and construction of such plunger assemblies and gas lift devices.

A newly drilled and completed well typically has enough pressure within the formation to cause liquids to flow from the formation to the surface without external assistance. Over time, the well's production volume and bottom-hole pressure may decline. When the well pressure is no longer sufficient to cause the liquids to flow to the surface, "liquid loading" or a "loaded well" condition may occur. Liquid accumulation in the downhole tubing creates a hydrostatic head that may exceed the well's natural pressure and cause production to decrease or cease altogether.

For wells that have excess liquids and/or insufficient pressure, it is often desirable to use a plunger lift system as an artificial lifting device that increases downhole pressure after natural well pressures have diminished. These systems may also be known as gas lift plungers, differential pressure operated pistons, bypass plungers, auto-cycling plungers, and the like. The plunger lift system usually requires little to no external energy and is designed to create enough pressure to efficiently "unload" or lift the liquids to the surface using residual pressure in the well. Accordingly, plunger lift systems are typically a cost effective solution to extend the life of the well.

During operation, the plunger is held in position within a lubricator located at the surface until ready for use. An internal valve component located inside an internal bore of the plunger is free to move within the plunger when the plunger is located in the lubricator. When the well is closed or production decreased and the flow of fluids and/or gases through the well tubing or piping decrease, the plunger is permitted to descend through the well tubing. The internal valve component moves to a position above flow ports located at a top of the plunger to permit flow through the flow ports. The plunger travels down the well tubing, due at least in part to gravity, and contacts a bumper spring assembly located in the downhole tubing. The bumper spring assembly absorbs the momentum of the plunger as it reaches the assembly, thereby protecting the plunger from damage.

Fall speeds of plungers (for example, pad, brush, solid, sand, and spiral type-plungers) typically range from about 50 to about 400 feet/minute. Other types of plungers (for example, bypass, continuous run, flow-through, ball & sleeve, sliding sleeve, etc.) are designed to fall through the well tubing while the well is producing. These types of plungers utilize features such as passageways or ports machined into the body or cage of the plunger that permit fluids to flow through the body of the plunger during descent. The fall speeds of these plungers may reach velocities as high as about 2000 feet/minute.

If fall speeds of the plunger are slow, shut-in or non-production time of the well may be increased and production may be lost or delayed. Alternatively, excessive speeds of the falling plungers may cause damage to components of the bumper spring assembly and/or the plunger. For example, components of the plunger, such as the head piece or cage, may become loosened and disconnect from the plunger body causing the plunger to be non-operable. Loose components may also travel through the well tubing uncontrolled and cause damage to the well casing/tubing or other structures. The loose components could also cause the plunger to become stuck or wedged in the well tubing. This could lead to increased well shut-in time while the problem is repaired, and may cause a substantial loss of production.

Typically, multiple designs and configurations of plungers must be manufactured and kept in stock to accommodate the various and changing conditions of wells such that the fall speed of the plunger may be controlled to minimize well shut-in time and damage to the components.

In accordance with the present disclosure, a plunger is provided that includes an internal component, for example, a ball, that functions as a valve, and passageways and/or flow ports that are configured to receive a plug to seal or to alter the passageway/flow port to adjust and control the flow of fluids, including oil, gas, and other fluids, through the plunger. The plunger of the present disclosure may be configurable to many different applications and may minimize the number of different plungers that must be manufactured and kept in inventory.

The plunger in accordance with the disclosure may be configured to freely descend and ascend within a well tubing as needed to lift the liquids to the surface and to restore well production. The plunger may include a self-contained component, such as a ball, that functions as a check valve by permitting flow through the plunger when the ball reciprocates to an open (bypass) position and prevents flow through the plunger in an opposite direction when the ball is moved to a closed position. Although the internal component is described herein as a ball, it is within the scope of this disclosure that any component that is configured to perform the functions described herein with respect to the internal valve component may be used. For example, the internal component could be an oblong or spherical component that may or may not include chamfered and/or radiused ends. However, these examples are not intended to be limiting.

When the plunger descends and the ball is in an open position, the flow ports in the plunger body are unobstructed by the ball and fluids and/or gases in the well are permitted to flow into the passageways, through the plunger body, and out the flow ports as the plunger descends through the well. Upon reaching the bumper spring assembly at a bottom of the well, the valve component or ball moves to a closed position and liquids in the well tubing are permitted to enter the plunger body through the open flow ports located above the ball. The liquids fill the internal bore of the plunger above the ball and a force created by the weight of the liquids holds the ball in the closed position. The plunger is thereby converted to a piston and the upward flow of fluids and/or gases through the well tubing are blocked, creating backpressure. The residual pressures in the well increase until the plunger and the liquids are lifted toward the surface. Upon reaching the lubricator at the surface, the fluid is passed through a surface conduit for recovery, the ball in the plunger is moved from the closed position, and the plunger is ready to repeat the cycle.

One or more of the passageways and/or flow ports may be configured to receive a plug to seal the passageway and/or the flow port and divert the flow of fluid and/or gas around the plunger body or to another passageway or flow port. By altering flow through the plunger, fall speeds of the plunger can be controlled and/or adjusted. The passageways and flow ports may be oriented at different angles, varied in number or size, relieved, sealed/plugged, etc. to alter and adjust the rate of descent of the plunger.

An end cap that includes the passageways may be connected to an end of the hollow plunger body with external or internal threads and secured with a crimp ("crimple") formed in one or more locations around the plunger body or end cap. The crimple may be a deformed portion of the wall of the plunger body or end cap that is inwardly-dented into a corresponding machined dent or groove in the external threads of the corresponding component. The crimple feature may eliminate the need for separate parts such as pins, screws, ball detents, lock nuts or washers, etc, to lock a threaded joint from rotating, and thus, loosening. The crimple feature of the disclosure may be used in place of set screws, pins, etc., to secure threaded components from turning relative to each other. Prevention of loosening the joint between the components may extend the life of the joint and, thus, the plunger.

FIG. 1 illustrates a bypass plunger 10 in accordance with the disclosure. The bypass plunger 10 includes a body portion 12. A fishing neck 14 including a ported head 16 is located at one end of the plunger body 12, and a tail portion having an end cap 13 is attached to an opposite end of the plunger body 12. The fishing neck 14 may be an internal or external type and may be a unitary part of the plunger body 12, as shown in FIG. 1. It is also within the scope of the disclosure that the fishing neck 14 and/or the ported head 16 could be manufactured as separate elements that are joined to the plunger body 12 via appropriate fastening means, such as threading, welding, etc.

Figure 8:
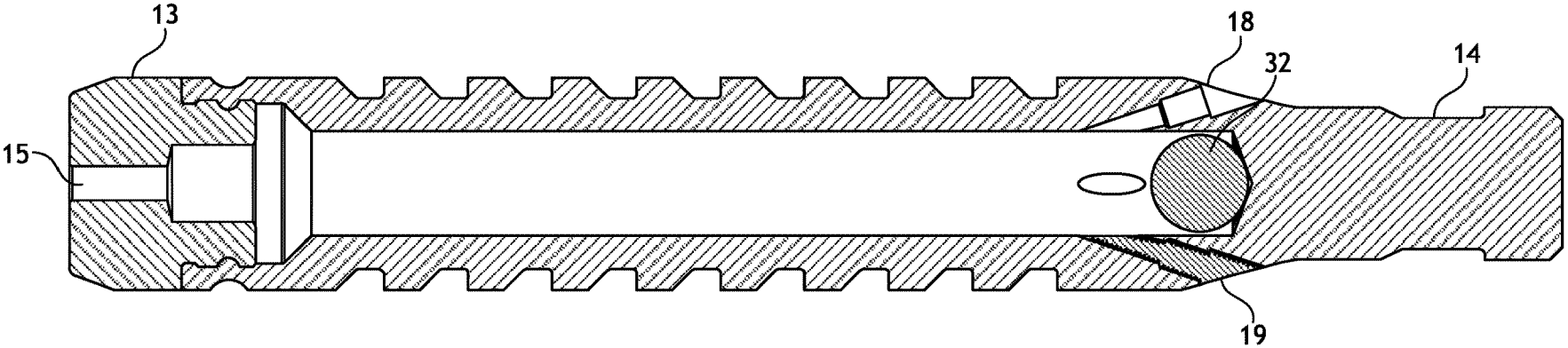
FIGS. 8 and 8A illustrate a side cross section view and detail view of a bypass plunger in an open position in accordance with the disclosure.

The end cap 13 is connected to the plunger body 12 via, for example, external threads located on an outer surface of the end cap 13 (shown in FIG. 8). However, it is contemplated that other suitable forms of connection may be used to fasten the end cap 13 to the plunger body 12. The connector or threads of the end cap 13 could be external, as shown, or internal to mate with, for example, external threads on a surface of the plunger body 12. One or more crimples 20 may be used to further secure the end cap 13 to the plunger body 12 and prevent rotation of the end cap 13 relative to the plunger body 12 after connection.

The end cap 13 may include an external circular groove around the threaded portion to facilitate deformation of the crimple 20 into the threaded portion of the end cap 13. Crimpling of the plunger body 12 at the location of the end cap 13 acts to lock the external threads of the end cap 13 to the corresponding internal threads of the plunger body 12. In an example embodiment, the crimple 20 is a deformed portion of the wall of the plunger body 12 that includes a radially inward extending dent in the outer surface of the plunger body 12, as shown in FIG. 1. The circular groove of the end cap 13 may be machined as a limited depth hole or a punched opening and may be round, oval, or rectangular in shape. Alternatively, the profile of the detent of the crimple 20 may be approximately conical in form, as though formed by a center punch having a conical point.

The ported head 16 of the fishing neck 14 may include flow ports 18 that extend through a wall of the plunger body 12, typically at equally-spaced locations around a circumference of the ported head 16. The flow ports 18 permit liquids, gases, and/or other fluids to flow into and/or through the plunger 10 and may be oriented at different angles, varied in number, relieved, sealed, and/or plugged to adjust flow rates through the plunger 10. By adjusting an amount of flow through the plunger 10, fall speeds of the plunger 10 may be controlled/optimized. In exemplary embodiments, flow through one or more of the flow ports 18 may be adjusted or blocked by sealing the flow port with a plug 19, as described below.

The plunger 10 is shown in the embodiment of FIG. 1, for example only, with four flow ports 18. However, any number of flow ports 18, as appropriate for the implemented environment, is considered to be within the scope of this disclosure. Any or all of the flow ports 18 may be configured to be plugged or sealed by a plug 19, and the plunger 10 is intended to be employed with any number, from zero to all, of the flow ports 18 including a plug 19. The greater the number of flow ports 18 that are sealed by plugs 19, the less fluids and/or gases are permitted to flow through the plunger 10, and thus, the slower the fall speed of the plunger 10. The plugs 19 may be attached to the flow port 18 via an appropriate fastening means determined by the intended environment. Plug fasteners may include, as non-limiting examples, threads (FIG. 8A), set screws, detents, retaining rings, welding, adhesives, etc., and/or the plug 19 may be held in the flow port 18 by interference fit.

Fluids and/or gases flow freely through the open flow ports 18 (FIG. 9) during descent, but are redirected through an open flow port 18 where the flow ports 18 are sealed or plugged by plug 19. The plug 19 prevents flow though the sealed/plugged flow port 18, which slows descent of the plunger 10 through the well tubing.

It is also within the scope of this disclosure that the plug 19 may be configured as a sleeve that includes a passage therethrough (not shown) that limits flow through the flow port 18. The plug sleeve which includes the passage effectively reduces the inner diameter of the flow port 18 and reduces an amount of fluids and/or gases that are allowed to flow through the plugged flow port 18. This modification permits further adjustment and control of the fall speeds of the plunger 10.

Figure 2:
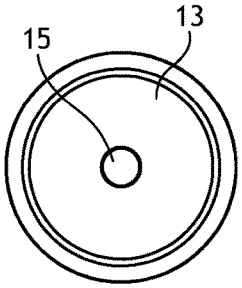
FIG. 2 illustrates an end view of the bypass plunger of FIG. 1 in accordance with the disclosure.

FIG. 2 illustrates an end view of the bypass plunger of FIG. 1 in accordance with this disclosure. The end of the bypass plunger 10 shown may include the end cap 13 attached to the plunger body 12 via the external threads and crimple 20, as discussed above.

The end cap 13 may also include one or more passageways 15. The passageways 15 permit liquids, gases, and/or other fluids to flow through the plunger 10 during descent of the plunger 10 through the well tubing as discussed herein. Passageways 15 may be oriented at different angles, varied in number, relieved, sealed, and/or plugged to adjust flow rates through the plunger 10. In accordance with the disclosure, flow through one or more of the passageways 15 may be adjusted or blocked by sealing the passageway 15 with a passageway plug (not shown), as described above with respect to the flow ports 18.

Figure 3:
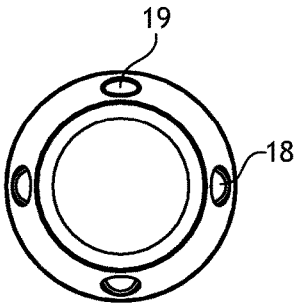
FIG. 3 illustrates another end view of the bypass plunger of FIG. 1 in accordance with the disclosure.

FIG. 3 illustrates another end view of the bypass plunger of FIG. 1 in accordance with the disclosure. This end of the plunger 10 includes the fishing neck 14 and the ported head 16. In the exemplary embodiment shown, the plunger 10 includes four equally-spaced flow ports 18 but the number of flow ports 18 may vary depending on the intended application. One or more of the flow ports 18 may be configured to receive a respective plug 19 to adjust the flow of fluids and/or gases through the plunger 10.

Figure 4:
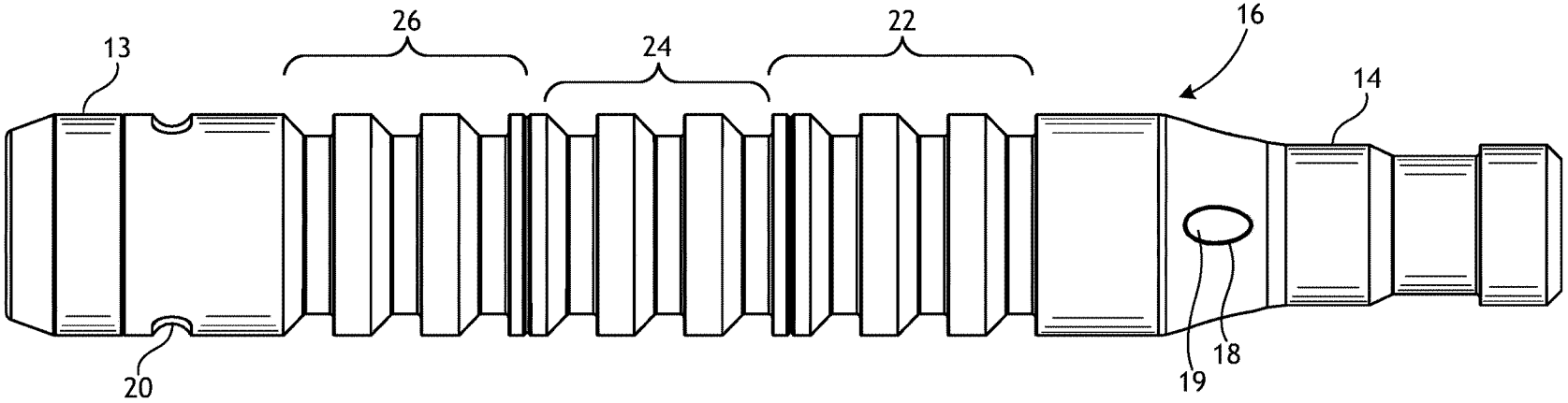
FIGS. 4 and 5 illustrate side views of a bypass plunger in accordance with the disclosure.
Figure 5:
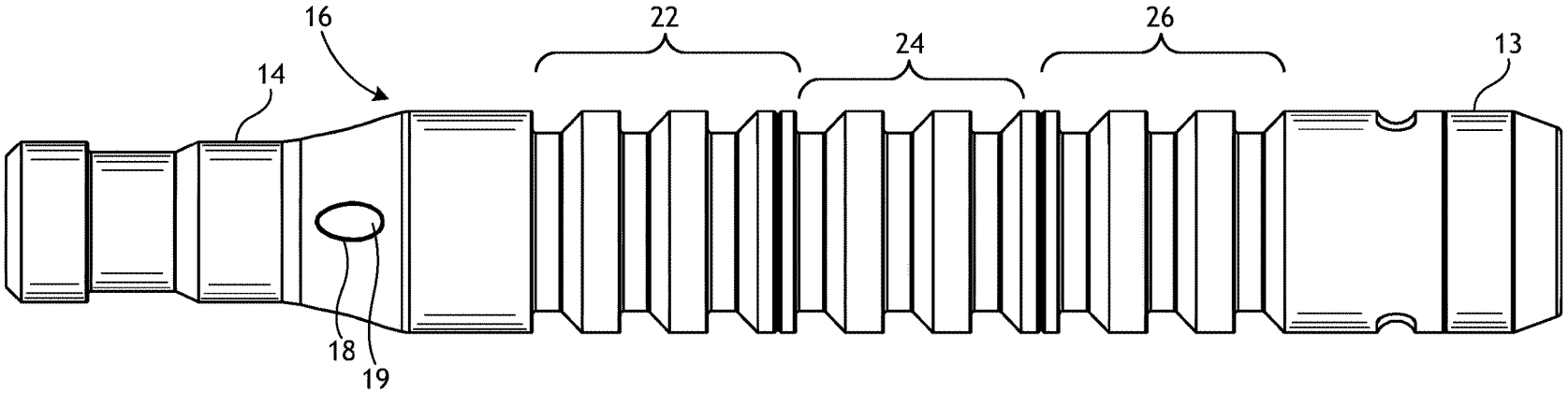
Figure 6:
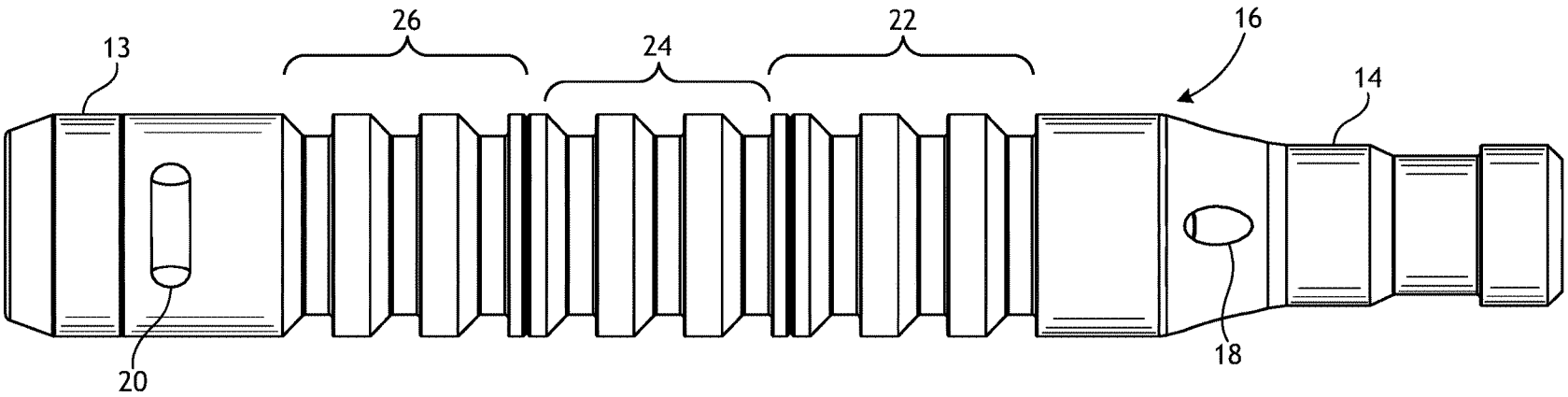
FIGS. 6 and 7 illustrate rotated side views of a bypass plunger in accordance with the disclosure.
Figure 7:
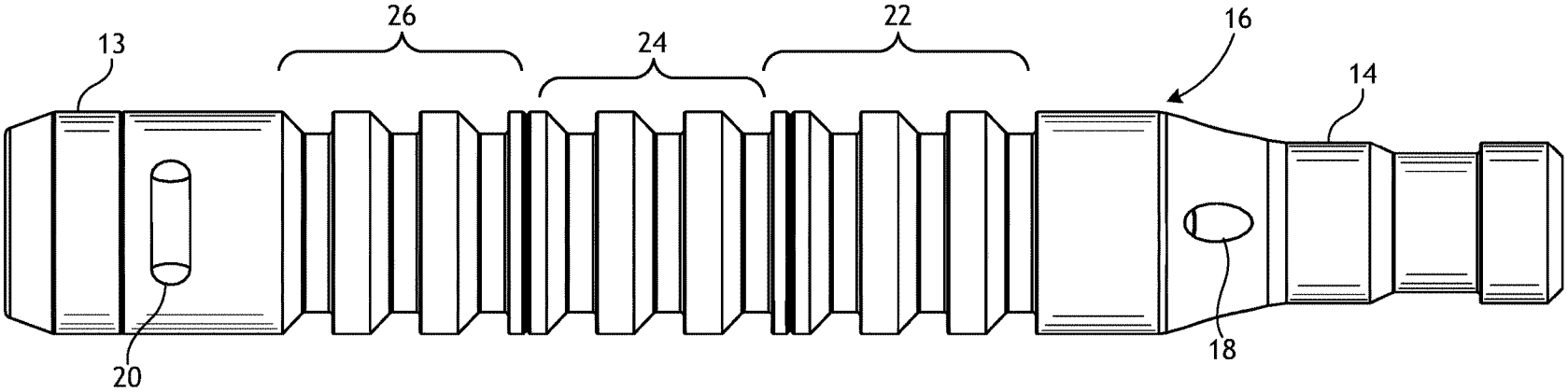

FIGS. 4 and 5 illustrate side views of the bypass plunger in accordance with the disclosure. FIGS. 6 and 7 illustrate side views of the bypass plunger in accordance with the disclosure that have been rotated 90 degrees. The outer surface of the plunger body 12 may include a series of rings or ridges machined into the outer surface of the hollow body for sealing a clearance between the plunger 10 and a sidewall of the well tubing. As shown, the outer surface may include an upper section of sealing rings 22, an intermediate or central section of sealing rings 24, and a lower section of sealing rings 26. The sealing rings 22, 24, 26 may extend from approximately one third of the overall length of the plunger body 12 to a full length of the plunger body 12, and may be arranged into groups.

In accordance with the disclosure, a series of spiral or helical grooves (not shown) may be machined into the outer surface of the plunger body 12 in place of one or more of the sealing ring groups 22, 24, 26, or between two groups of sealing rings 22, 24, 26. For example, any or all of the sealing ring sections 22, 24, 26 may be replaced by a helical groove which may be varied between a tight helix and an open helix to vary a rate of spin of the plunger 10 as it descends and ascends. This spinning of the plunger 10 may prevent flat spots from forming on the outside surface of the plunger 10. Such flat spots could reduce the effectiveness of the remaining sealing rings and, thus, reduce the useful life of the plunger 10. In addition, the pitch and cross section profile of the helical grooves may also be varied to adjust the spin rate of the plunger 10.

Figure 8A:
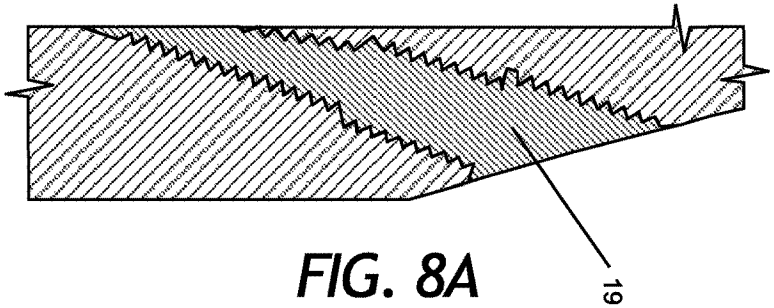

FIGS. 8 and 8A illustrate a side cross section view and a detail view of a bypass plunger in an open position in accordance with the disclosure. When the plunger is ready to descend through the well tubing, the internal valve component or ball 32 unseats from a position on the end cap 13 and rises to a location above the flow ports 18, near or at a top of the internal bore of the plunger 10 (the open position). Although the internal valve component is shown as ball 32, any component that is configured or shaped to move between a seated position at the end cap 13 end of the plunger body 12 to a seated position at the top of the plunger body 12 such that the flow ports are unobstructed is within the scope of the disclosure. As non-limiting examples, the internal valve component could be an oblong or spherical component that may include chamfered and/or radiused ends.

In the open position shown in FIG. 8, the ball 32 is located above the flow ports 18 and flow of fluids and/or gases through the unplugged flow ports 18 is unobstructed. Flow is then permitted to enter the plunger 10 through the passageway 15 in the end cap 13, travel through the internal bore of the plunger 10, and exit the plunger 10 through the flow ports 18, as shown in FIG. 9.

Figure 9:
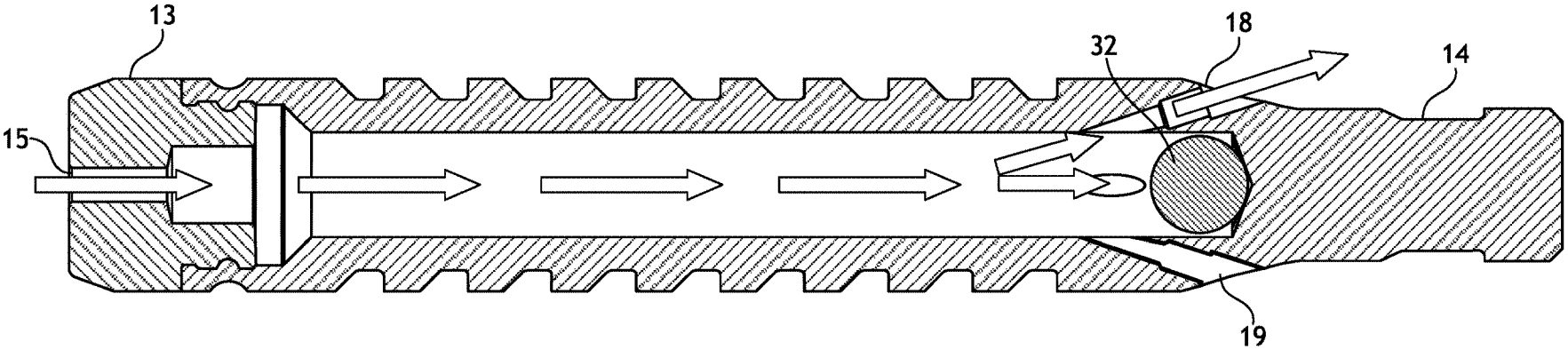
FIG. 9 illustrates a side cross section view of a bypass plunger during descent in accordance with the disclosure.

FIG. 9 illustrates a side cross section view of a bypass plunger during descent and in a bypass condition with the ball 32 in the opened position in accordance with the disclosure. As shown by the arrows in FIG. 9, when the plunger 10 descends through the well tubing, fluids and/or gases enter the unplugged passageways 15 in the end cap 13, flow through the internal bore of the plunger 10, and exit the plunger 10 through the unplugged flow ports 18. One or more of the passageways 15 and/or flow ports 18 may be configured to receive a plug 19 to seal the respective passageway 15 and/or the respective flow port 18, and divert the flow of fluid and/or gas around the plunger body 12 or to another unplugged passageway 15 or flow port 18.

By permitting the flow of fluids and/or gases through the plunger 10 (the bypass condition), the plunger 10 is able to fall through the well tubing at increased speeds compared to conventional plungers that do not have a bypass feature. The pluggable passageways 15 and pluggable flow ports 18 permit the fall speed of the plunger 10 to be adjusted as needed to minimize well shut-in time and prevent damage to the plunger 10 and the downhole bumper spring assembly 100 (FIG. 10).

Figure 10:
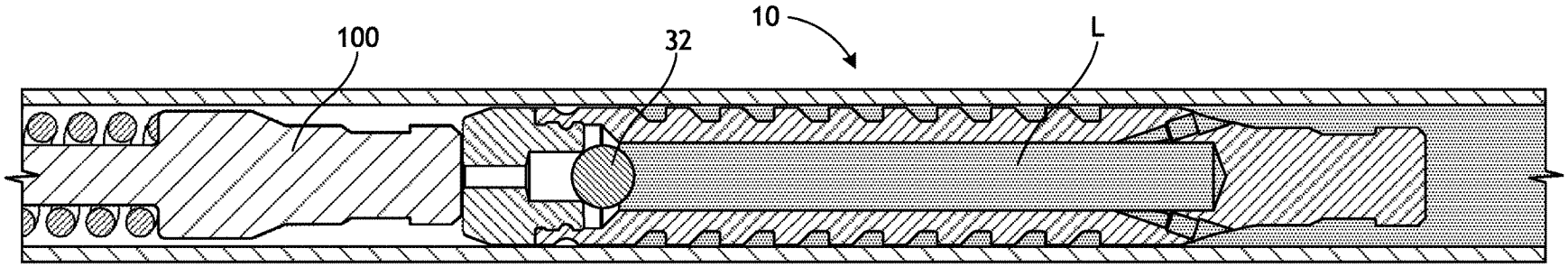
FIG. 10 illustrates a side cross section view of a bypass plunger after descent in accordance with the disclosure.

FIG. 10 illustrates a side cross section view of a bypass plunger in a closed position after descent through the well tubing in accordance with the disclosure. When the plunger 10 reaches the bumper spring assembly 100 at the bottom of the well tubing, liquids L that are located above the bumper spring assembly 100 enter the internal bore of the plunger 10 through the unplugged flow ports 18 at the top of the plunger 10. Liquids L accumulate within the internal bore of the plunger 10 and create a force/pressure on a top surface of the ball 32 that is sufficient to hold the ball 32 in a seated check position at a bottom of the plunger 10. Due to the force of the liquids on top of the ball 32, fluids that may otherwise enter the internal bore of the plunger 10 through the passageway 15 are blocked by the ball 32 preventing the bypass condition. The plunger 10 is thus converted to a piston and backpressure is created within the well tubing.

In this configuration, once sufficient backpressure builds up in the well, the plunger 10 and the fluids located above the plunger 10 are lifted and ascend to the surface. Liquids L within the internal bore of the plunger 10 are retained within the plunger to maintain the force on the ball 32 during ascent, creating an efficient seal between the ball 32 and the end cap 13 and generating artificial lift.

Figure 11:
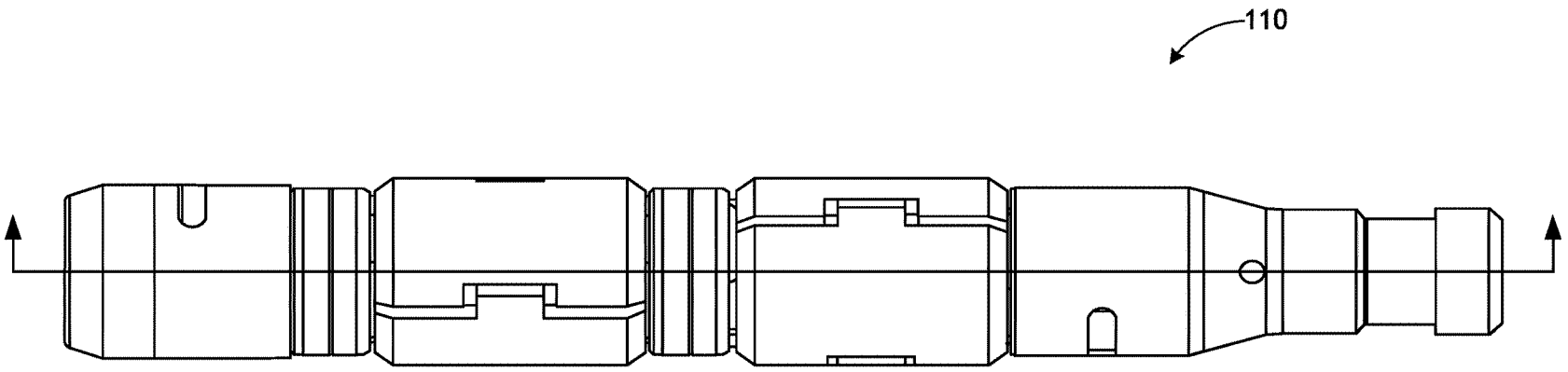
FIGS. 11 and 11A illustrate a side view and a side cross section view of a bypass plunger in accordance with the disclosure.
Figure 11A:
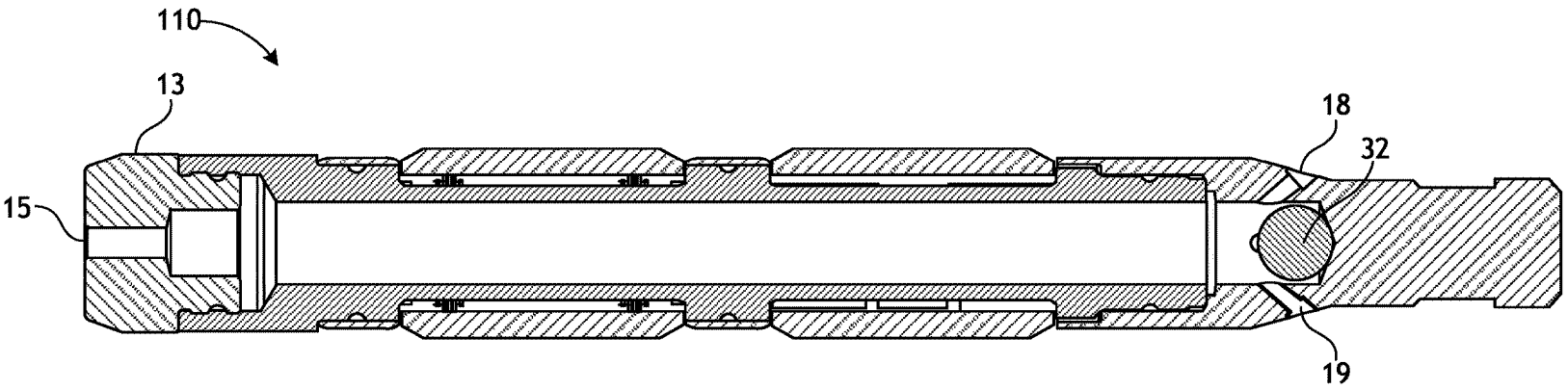

FIGS. 11 and 11A illustrate a side view and a side cross section view of a pad-type bypass plunger 110 in accordance with the disclosure. As a non-limiting example, FIGS. 11 and 11A show the internal valve component 32 and the pluggable passageways 15 and flow ports 18 in an exemplary embodiment of a pad-type bypass plunger 110. It is within the scope of the disclosure that the features of the present disclosure may be used in any other type of plunger assembly or gas lift system that utilizes a bypass feature.

Figure 12:
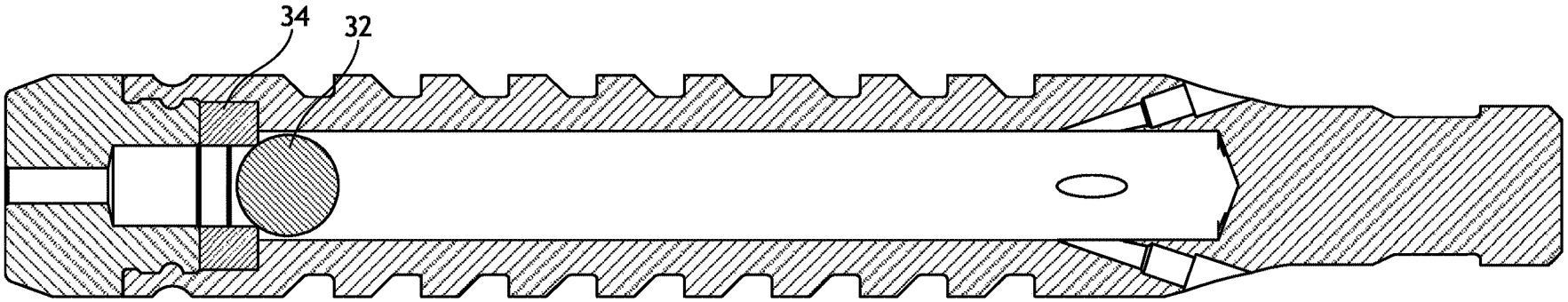
FIG. 12 illustrates a bypass plunger in accordance with the disclosure.

FIG. 12 illustrates a bypass plunger in accordance with the disclosure. In FIG. 12, an exemplary embodiment is shown that includes a valve seat 34 for the ball 32 to seat and seal with during ascent of the plunger 10. It is noted that other variations of the valve seat 34 and end cap 13 are considered to be within the scope of this disclosure and additional components, such as seals, etc., for example only, may be included within the plunger 10 without departing from the scope of the disclosure.

Conditional language, such as, "can," "could," "might," or "may," unless specifically stated otherwise, or otherwise understood within the context as used, is generally intended to convey that certain implementations could, but do not necessarily, include certain features and/or elements while other implementations may not. Thus, such conditional language generally is not intended to imply that features and/or elements are in any way required for one or more implementations or that one or more implementations necessarily include these features and/or elements. It is also intended that, unless expressly stated, the features and/or elements presented in certain implementations may be used in combination with other features and/or elements disclosed herein.

The specification and annexed drawings disclose example embodiments of the present invention. The examples illustrate various features of the disclosure, but those of ordinary skill in the art will recognize that many further combinations and permutations of the disclosed features are possible. Accordingly, various modifications may be made to the disclosure without departing from the scope or spirit thereof. Further, other embodiments may be apparent from the specification and annexed drawings, and practice of disclosed embodiments as presented herein. Examples disclosed in the specification and the annexed drawings should be considered, in all respects, as illustrative and not limiting. Although specific terms are employed herein, they are used in a generic and descriptive sense only, and not intended to the limit the present invention.

What is claimed is:

1. A bypass plunger, comprising:

a plunger body including a head portion located at one end of the plunger body and having at least one flow port, and a tail portion located at an opposite end of the plunger body and having at least one passageway;

a valve component disposed within an internal bore of the plunger body and moveable between an open position and a closed position; and at least one plug each located within a respective one of the at least one flow port or the at least one passageway and configured to reduce or prevent flow through the respective flow port or the respective passageway, wherein in the open position, the valve component is located between the at least one flow port and a head end of the plunger body and, in the closed position, the valve component is located on an opposite side of the at least one flow port and restricts flow from the at least one passageway to the at least one flow port.

2. The bypass plunger of claim 1, wherein the at least one plug is fastened to the respective flow port or the respective passageway via a retaining ring, thread, set screw, or detent.

3. The bypass plunger of claim 1, wherein the at least one plug is fastened to the respective flow port or the respective passageway via welding or adhesive.

4. The bypass plunger of claim 1, wherein the at least one plug is fastened to the respective flow port or the respective passageway via interference fit.

5. The bypass plunger of claim 1, wherein the at least one flow port is at least two flow ports, and at least one of the at least two flow ports does not include a plug therein.

6. The bypass plunger of claim 1, wherein the plunger body includes an end cap connected to the tail portion.

7. The bypass plunger of claim 6, wherein the end cap includes the at least one passageway.

8. The bypass plunger of claim 6, wherein relative rotation between the end cap and the plunger body is locked by at least one crimple detent.

9. The bypass plunger of claim 8, wherein the at least one crimple detent includes a dent formed in a wall of the plunger body or a wall of the end cap, and the dent extends radially inward into the wall of the other of the end cap or plunger body.

10. A bypass plunger, comprising:

a plunger body including a head portion and a tail portion;

at least one flow port in the head portion;

at least one passageway in the tail portion;

a ball located within an internal bore of the plunger body and moveable along a length of the internal bore between an open position and a closed position; and at least one plug each located within a respective one of the at least one flow port and the at least one passageway, and configured to reduce or prevent flow through the respective flow port or the respective passageway, wherein in the open position, the ball is located between the at least one flow port and a head end of the plunger body and, in the closed position, the ball is located on an opposite side of the at least one flow port and restricts flow from the at least one passageway to the at least one flow port.

11. The bypass plunger of claim 10, wherein the at least one plug is fastened to the respective flow port or the respective passageway via a retaining ring, thread, set screw, or detent.

12. The bypass plunger of claim 10, wherein the at least one plug is fastened to the respective flow port or the respective passageway via welding or adhesive.

13. The bypass plunger of claim 10, wherein the at least one plug is fastened to the respective flow port or the respective passageway via interference fit.

14. The bypass plunger of claim 10, wherein the at least one flow port is at least two flow ports, and at least one of the at least two flow ports does not include a plug therein.

15. The bypass plunger of claim 10, wherein plunger body includes an end cap connected to the tail portion.

16. The bypass plunger of claim 15, wherein the end cap includes the at least one passageway.

17. The bypass plunger of claim 15, wherein relative rotation between the end cap and the plunger body is locked by at least one crimple detent.

18. The bypass plunger of claim 17, wherein the at least one crimple detent includes a dent formed in a wall of the plunger body or a wall of the end cap, and the dent extends radially inward into the wall of the other of the end cap or plunger body.

* * * * *